United States Patent [19]

Galya et al.

[11] 3,949,689

[45] Apr. 13, 1976

[54] SEWING MACHINE FABRIC EDGE FLIP-UP GUIDE

[76] Inventors: William Galya, Rte. No. 2 Merriden Drive, Brewster, N.Y. 10509; Jack E. Shuffield, 29 Carpenter Ave., Norwood, N.J. 07648

[22] Filed: May 31, 1974

[21] Appl. No.: 475,039

[52] U.S. Cl. ..... 112/151; 112/153

[51] Int. Cl.[2] ..... D05B 35/10

[58] Field of Search ..... 112/151, 153, 143, 136, 112/139, 141

[56] References Cited

UNITED STATES PATENTS

| | | | |
|---|---|---|---|
| 615,463 | 12/1898 | Shaft | 112/153 |
| 790,780 | 5/1905 | Bryce | 112/153 |
| 2,210,647 | 8/1940 | Ackerman | 112/143 |
| 3,020,864 | 2/1962 | Katz | 112/153 |

*Primary Examiner*—H. Hampton Hunter

[57] ABSTRACT

In a preferred embodiment there is provided a plate having paired side by side parallel grooves therein for mounting vertically on a rearward face of a sewing machine structure above and behind the fork-carrying foot, the grooves extending vertically, with a laterally extending horizontal track structure carrying a track structure axial shaft axially adjustable within the track and there being an upwardly and downwardly pivotable arm mounted pivotably on the laterally extending axial shaft and having on a lower distal end of the pivotable arm a revolvable flat faced wheel rotatable in a horizontal flange closely adjacent to a side lateral face of the forks of the foot and extending slightly below the bottom face of the forks such that as fabric is fed along the platen plate beneath the forks the flat face of the revolvable wheel serves to guide the edge of the fabric assuring a consistent predetermined spacing of the stitching from the edge of the fabric.

7 Claims, 8 Drawing Figures

Fig. 1.
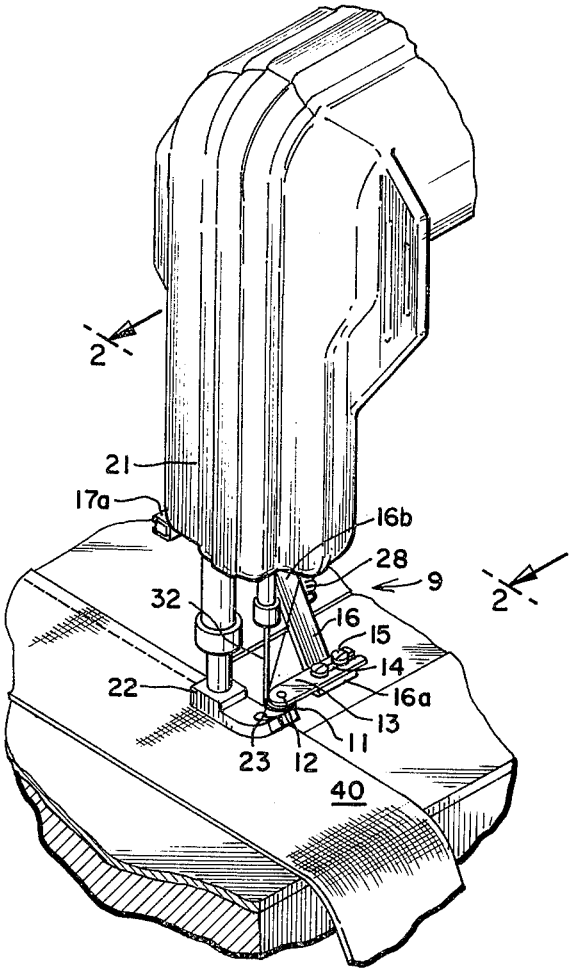
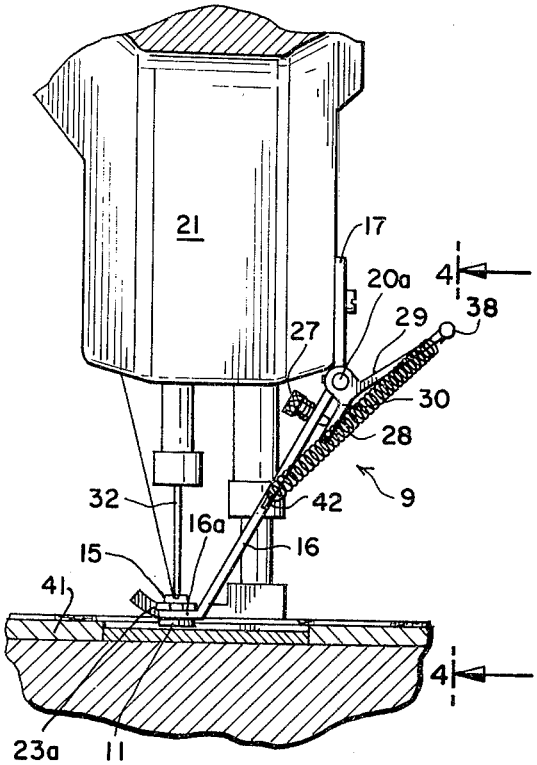
Fig. 2.
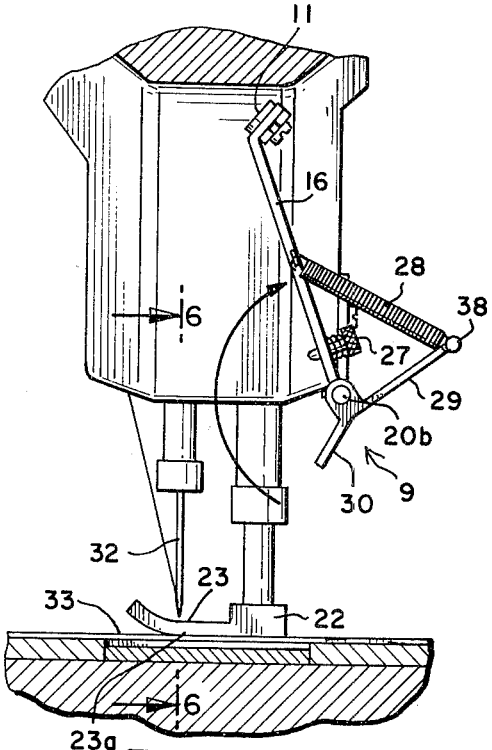
Fig. 3.
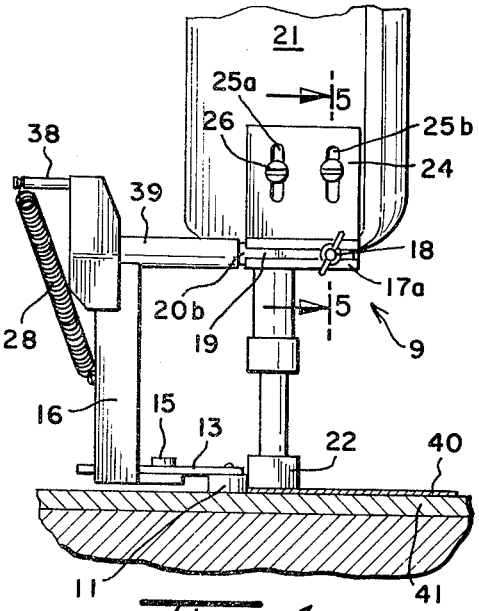
Fig. 4.

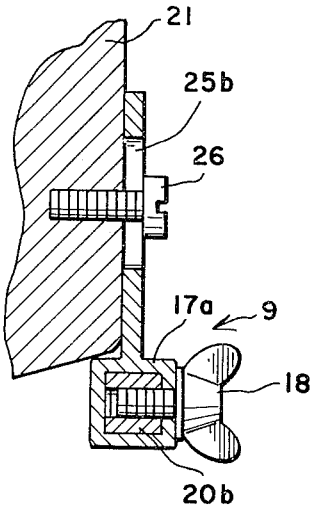
Fig. 5.
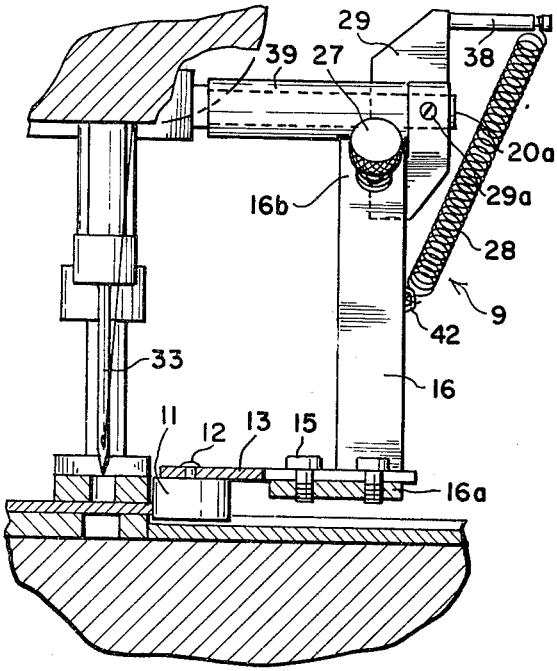
Fig. 6.
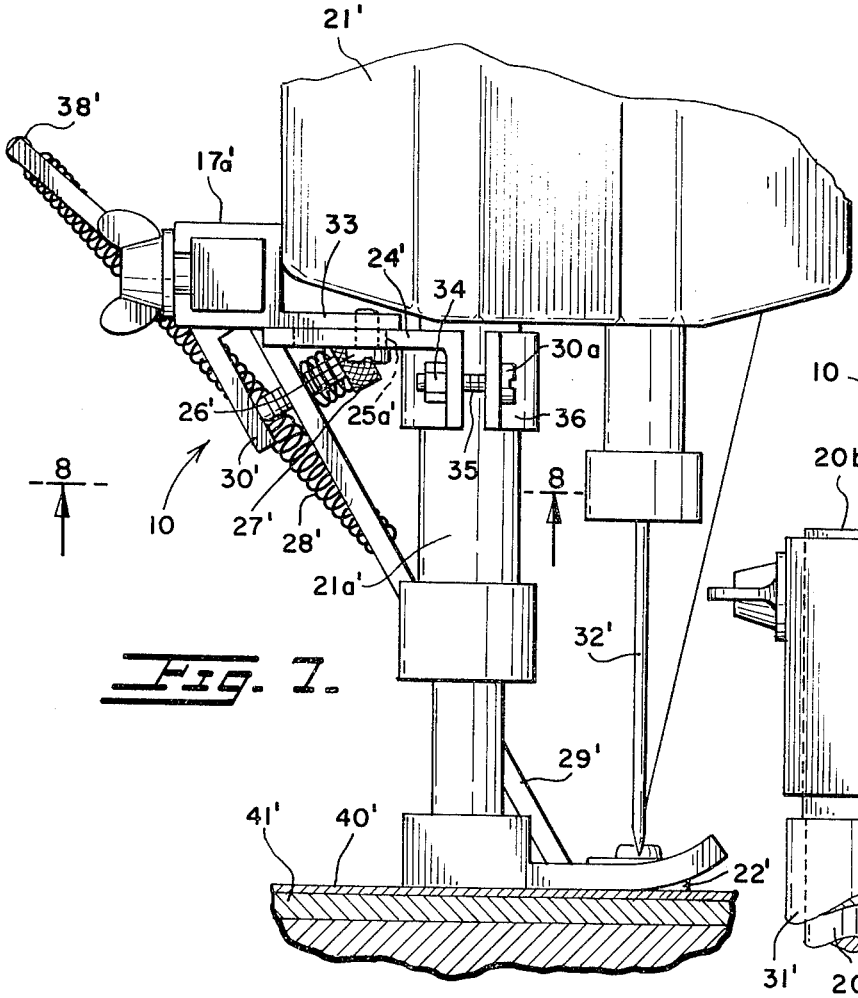
Fig. 7.
Fig. 8.
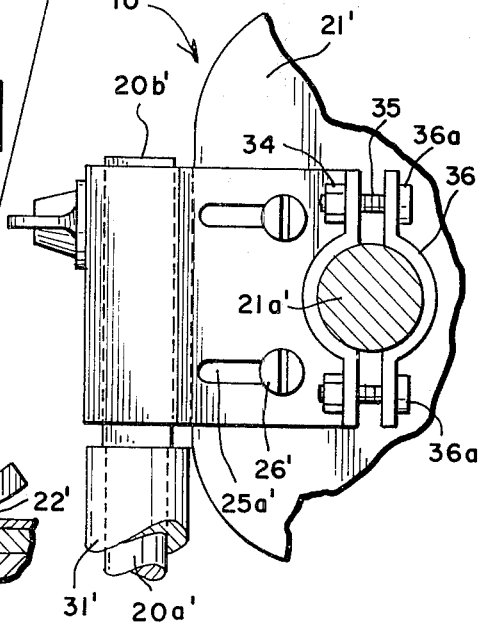

SEWING MACHINE FABRIC EDGE FLIP-UP GUIDE

This invention relates to a sewing machine fabric-edge guide.

BACKGROUND TO THE INVENTION

Prior to the present invention there have existed fabric-edge guides for industrial sewing machines but such guides had the disadvantage of getting-in-the-way during manipulation of the fabric prior to and subsequent to the sewing operation. Also, the reason for this arose from the fact that the fabric edge-guide was intergral with the platen plate. Being intergral with the platen plate there also accompanied the problems of inflexibility in so far as making adustments for narrower or wider margins between the edge of the fabric and the fabric and the point of sewing with the sewing machine needle during the stitching of the fabric. Also, there was no way of adjusting the fabric guide forwardly or backwardly along the side of the foot and forks thereof on the sewing machine to individualize for differences in the texture of fabric being guided by the guide structure. Also, depending upon the thickness of the fabric, as well as depending upon the wear and tear over extended use on the roller and its mounting shaft, there heretofore was no way of adjusting the closeness of the roller to the platen plate for most efficient and fault-free operation thereof. Also the use of the spring to hold the revolvable guiding wheel in its position appeared not to be practicable because the spring biasing toward the side of the foot and forks thereof would cause the guide to pinch the fabric as well as cause or being subject to variations because of the fact that the spring could yield to pressure of the fabric as the worker attempted to guide the fabric path under the forks of the foot.

SUMMARY OF THE INVENTION

Accordingly, objects of the present invention included the overcoming of one or more of the above difficulties and problems and disadvantages, together with providing a portable and dismountable edge-guide.

Another object is to provide for a flip-up flip-down type fabric edge-guide structure which nevertheless maintains constant and unchanging fixed position relative to the side of the sewing machine foot and forks thereof and spaced therefrom a predetermined distance.

Another object is to obtain a fabric edge-guide of the type preferred to in the preceeding objects, together with the object to obtain variable adjustability in different dimensions such as lateral distance from the side lateral face of the forks of the foot, and variable distances upwardly and downwardly from the platen plate.

Another object is to obtain variable adjustments for the forward-to-rearward positioning of the fabric edge-guide roller.

Another object is to obtain a spring-biased flip-up and flip-down mechanism utilizing a simple structure and a common spring for retaining the support arm in each respectively of flip-up and flip-down states.

Other objects become apparent from the preceeding and following disclosure.

One or more objects of the present invention are obtained by the invention as defined herein.

The flip-up and flip-down fabric edge-guide device of the present invention is in essence protable in its nature mountable on any of conventional sewing machines in the vinicity of the support structure of the sewing machine foot such that the flip-arm thereof may be flipped up and detained in the flipped-up position by the same mechanism that retains the arm flipped flip-fown state, while including variable adjusters for altering the position of the roller fabric-edge guide, for example laterally by virtue of two set screws within a slot of the roller-support lower laterally-extending structure such that by adjustment slidably of the slot-structure around the screws to and fro, the distance toward or away from side face of the foot fork may be fixedly adjusted and such that the degree of downwardly pivoting of the arm may be fixedly adjusted by virtue of a set-screw which may be screwed further inwardly through the pivotable arm to raise the lower extent to which the arm will swing or may be withdrawn screwably, to lower the extent to which the pivotable arm will swing downwardly, together with the mounting structure of the axial on which the pivotable arm is pivotably mounted, being mounted on the foot-support structure itself in manner allowing the raising and lowering of the pivotable arm axis structure relative to the sewing machine foot support structure and platen plate. In one embodiment of the invention, the base mounting plate on which the laterally extending axial shaft is fixably attached there are paired parallel vertically extending slots to which set screws are screwed into the back face of the sewing machine's foot-mounting support structure. In alternate embodiment, the axial mounting structure on which pivotable arm is mounted, is mounted on the typically eccentrically shaped foot-support structure immediately above the foot by virtue of a biased-type adjustable clamp which by conventional set screws may be loosened and tightened for adjusting the height of the overall arm structure and the edge-guide roller in elevation downwardly and upwardly relative to the plate. For securing the contant and fixed position of a roller which is the preferred means for providing pressure to the fabric for the present invention, a flat face roller is employed, and the inventive roller as described above is normally fixed with regard to prevention of the roller moving away from laterally the side of the forks of the foot, such that pressure always is the same and the position is always the same once the set screws have been set, but nevertheless providing for upward and downward spring-biased pressure which does not alter the setting or make variable the setting of the positioned fabric edge-guide. Additionally, a novel feature of the present invention is the use of a common stretch-spring for achieving a toggle-switch type leverage on the pivot arm thereby utilizing a single spring of simple structure and low cost for effecting secure downward pressure and retaining of the pivoted arm in the downwardly flipped state, while currently providing for the same spring to maintain the pivoted arm in its flipped-up state once flipped thereto manually. Another novel feature of the present invention is the extension of the lower arm from the same fixed structure to which the spring is attached on an upper arm thereof, the arm being used as a base against which a spring biased set screw extending threadably through the pivotable arm may be pressed at variable points in order to determine the extent to which the pivotable arm will be permitted to move downwardly to its downward-most position of pivot.

The invention may be better understood by making references to the Figures as follow.

THE FIGURES

FIGS. 1 through 6 illustrate a first and preferred embodiment of the invention, while FIGS. 7 and 8 illustrate an alternate embodiment thereof.

In more particularly, FIG. 1 illustrates a perspective view of the preferred embodiment as view in a forward overhead lateral position, in an in-part of the sewing machine.

FIG. 2 illustrates a view of the FIG. 1 embodiment as taken along lines 2—2 thereof.

FIG. 3 illustrates a view in side view and partial cross-section of the platen plate, comparable to that of FIG. 2 except that whereas FIG. 2 is in the flip-down state, FIG. 3 illustrates the flip-up state of the same embodiment.

FIG. 4 illustrates a view as taken along lines 4—4 of FIG. 2, in a rear view of the overall structure of FIG. 1.

FIG. 5 illustrates a cross-sectional and in-part view of the mounting structure together with its slots and set screw and the lateral variable mechanism and structure thereof as taken along lines 5—5 of FIG. 4, for the embodiment of the preceeding Figures.

FIG. 6 illustrates a forward cross-sectional view taken partial cross-section as taken along lines 6—6 of the FIG. 3 embodiment, as viewing the structure from a forward position in front of the sewing machine.

In the embodiment of FIGS. 7 and 8, the overall mechanism corresponds substantially to that of the corresponding other Figures, with minor variation and shapes, but with the mounting structure for the mounting onto the support structure differing by virtue of the use of a biased-typed clamp structure with set screws and nuts therefore for mounting around the cylindrical portion of the foot support structure.

The particular Figure view of FIG. 7 is a side view in partial cross-section as viewed from the left side of the sewing machine, substantially in elevation view.

In contrast, the FIG. 8 illustrates a cross-sectional view through the cylindrical support structure of the foot, and a bottom elevation view of the mounting structure and showing in-part the laterally-extendable axle shaft on which the pivotable arm is mountable. This view of FIG. 8 as taken along lines 8—8 of FIG. 7.

DETAILED DESCRIPTION OF THE INVENTION

FIGS. 1 through 6 illustrates a preferred embodiment of the present invention in its mounted state on a sewing machine shown in-part, this preferring embodiment being designated as embodiment 9 in these Figures, whereas FIGS. 7 and 8 discloses an embodiment 10 which differs some what in the shape of the supporting structure and the mounting mechanism thereof for clamping onto the typically cylindrically-shaped sewing machine foot support structure 21*a'* as compared to the embodiments of FIGS. 1 through 6 which mounts on the sewing machine support structure 21 from which the foot 22 also is mounted.

In greater particularity, with reference to the FIGS. 1 through 6, FIG. 1 illustrates the flat peripheral faced revolvable wheel 11 mounted on an axle 12 secured within the lower support horizontal laterally extending strip 13 variably mounted on the lower portion 16*a* of arm 16 by lock screws 15 within the slot 14 of the strip 13 making possible a lateral adjustment to points closer or farther away from the face 23*a* (see FIG. 3) of the fork structure 23 of the foot 22. Mounted within the upper portion 16*b* of the pivotable arms 16 is a lock and adjusting screw 27 for pressing downwardly resting on the fixed vertically-extending arm 30 mounted fixedly on the shaft 20 *b* and having an upper-extending arm 29 with a securing element 38 under which spring 28 is mounted at one end thereof and with the other end of the spring being mounted at element 42 of the arm 16. The diameter of the axle 20*a* is of lesser diameter than its opposite ends 20*b* as may be seen, for example, in FIGS. 3 and 4 but particularly in the FIG. 6, such that the end portion of the tubular member 39 onto which the arm 16 is fixedly intimately mounted, abutts the flattened end of the enlarged portion of the axle end 20*b*. The arms 29 and 30 are secured on the axis 20*a* by lock-nut screw 29*a*. The fabric 40 as shown clearly in FIG. 1 is guided against the flat face of the revolvable wheel 11 beneath the foot toes 23 of the foot 22. The overall pivot arm structure is fixedly mounted onto the sewing machine foot support structure 21 by virtue of a plate as seen in FIG. 4 as plate 24 having paired parallel grooves 25*a* and 25*b* with lock screws 26 and having mounted thereon a horizontally-extending groove-defining structure 17*a* defining groove 19 through which the lock key 18 secures the axle 20*b* at its predetermined position for adjusting the closeness of the arm 16 to the foot and accordingly in adjusting the flat-faced wheel 11 in closeness but spaced from the face 23*a* of the fork 23. Additionally however, as noted above, the lock screws 15 also serve to act coordinate with the grooves 14 of the slidable member 13 for further fine adjustments of the closeness of the flat faced wheel 11 to the forks 23. As illustrated in the FIGS. 2 and 3 in particular it may be readily seen that the spring 28 on the arms 29 and 16 act in the nature of a toggle-switch for holding firmly down the arm 16 into the downwardly pivoted state, or when flip-up for holding the 16 firmly in the upwardly flip-state. The fabric 40 slides advancingly along the flat plate 41.

In the embodiment of FIGS. 7 and 8, the parts thereof such as the groove-defining structure 17*a'* corresponds to that of 17*a* in the prior described preferred embodiment, this particular embodiment of FIGS. 7 and 8 accordingly being identified by corresponding numbers with a prime associated therewith, except for the differences in structure such as the annually or arcuate shaped clamped structure 36 having lock screws 36*a* and its threaded shaft 35 with the mounting nut 34 thereon for clamping firmly around the cylindrically shaped foot support structure 21*a'*. It should be noted however that in the particular embodiment illustrated of FIGS. 7 and 8, the structure 17*a'* is mounted on a separate support structure 33 which is secured by nut 26' to the structure 24'. There is provided a suitable conventional flange extending from an upper part of the tubular portion 39 such that when the arm 16 flips upwardly, it engages the member 29 in a manner in which prevents the arm from flipping further rearwardly (this conventional part not being illustrated).

It is within the scope and contemplation of the present invention to make such variations, modifications, and substitutions of equivalents as would be apparent to a person of ordinary skill in this particular field.

We claim:

1. A sewing machine fabric edge-guide device comprising in combination: a sewing machine foot support structure; a mounting arm support means for the mounting thereof at higher and lower positions on said sewing machine foot support structure and having a distal end thereof spaced from the sewing machine structure, and for mounting of a substantially laterally-extending shaft; a shaft structure means for axially, adjustably, and variably mounting thereof in position and for locking thereof into a fixed state relative to the sewing machine foot support; roller fabric-guide support pivot means for mounting a proximal end onto the shaft structure means pivotably for upward and downward pivoting motion on a distal end of said shaft structure means; said roller fabric-guide support pivot means including at its distal end a substantially round roller structure mounted revolvably in a substantially horizontal plane when the roller fabric-guide support pivot means is flipped downwardly and adapted when flipped downwardly to place the round roller structure above and adjacent to a sewing machine work plate, adjacent a lateral side of the sewing machine foot and adapted such that an edge of a fabric is guidable thereby; and toggle spring means for mounting thereof fixedly relative to said laterally-extending shaft structure and for connecting to said roller fabric-guide support pivoting means for pivotably retaining the roller fabric-guide support pivoting means alternately in each of the flipped upwardly and flipped downwardly positions respectively.

2. A sewing machine fabric-guide device of claim 1, in which said roller fabric-guide support pivoting means further includes an upper arm portion including a variable adjusting means for altering the extent to which the upper arm portion pivots downwardly in its downwardly-pivoted state.

3. A sewing machine fabric edge-guide device of claim 2, in which the roller fabric-guide support pivoting means further includes a lower substantially horizontally-extending and laterally adjustable portion having mounted thereon a lock means for releasably locking the lower portion into a fixed state relative to the upper portion.

4. A sewing machine fabric edge-guide device of claim 3, in which said lower portion includes a laterally slidable plate lockable to the upper portion by at least one set screw as said lock structure, and having on a distal end thereof adjacent the sewing machine foot structure's lateral side face, a downwardly extending shaft having revolvably mounted thereon said round roller structure in the form of a revolvable wheel structure having a substantially flat wheel peripheral upright face revolvable around the downwardly extending shaft with the flat face being about parallel to and spaced a minor predetermined distance from said sewing machine foot structure's side face, with a portion of the flat wheel peripheral upright face extending below a lower extent of the sewing machine foot structure's lateral side face.

5. A sewing machine fabric edge-guide device of claim 4, in which said variable adjusting means comprises a threaded screw biased against a lower arm downwardly extending of said toggle-spring means, and in which the toggle-spring means further includes an upwardly extending arm and said spring stretched between said upwardly extending arm and a lower part of said upper portion of said roller fabric-guide support pivoting means.

6. A sewing machine fabric-edge-guide device of claim 5, in which said mounting arm support means includes vertically extending slots and set screws extending through said vertically extending slots and threadably mounted within threaded female holes within said sewing machine foot support structure.

7. A sewing machine fabric edge-guide device of claim 5, in which said mounting arm support means includes a vise-like clamping structure shaped for vise-mounting around an upper sewing machine foot structure, and set screws for tightening and locking the vise-like clamping structure onto said sewing machine foot structure.

* * * * *